US006219935B1

(12) United States Patent
Daunoy

(10) Patent No.: US 6,219,935 B1
(45) Date of Patent: Apr. 24, 2001

(54) HAIR DRYING METHOD INCLUDING AN EYEGLASS ASSEMBLY

(76) Inventor: Maybell B. Daunoy, 2431 New Orleans St., New Orleans, LA (US) 70119

( * ) Notice: Subject to any disclaimer, the term of this patent is extended or adjusted under 35 U.S.C. 154(b) by 0 days.

(21) Appl. No.: 09/533,133

(22) Filed: Mar. 23, 2000

(51) Int. Cl.[7] ..... A45D 20/00
(52) U.S. Cl. ..... 34/283; 2/426
(58) Field of Search ..... 34/283, 96, 97, 34/98, 99, 100, 101; 132/206, 272; 2/9, 10, 426, 171.1, 172, 195.5

(56) References Cited

U.S. PATENT DOCUMENTS 4,301,601 * 11/1981 Carr ..... 34/283
5,206,956 5/1993 Olson ..... 2/13
5,214,804 * 6/1993 Carey et al. ..... 2/206
5,245,709 9/1993 Shipcott ..... 2/425
5,247,706 9/1993 Mark ..... 2/9
5,297,298 3/1994 Salatka et al. ..... 2/447
5,471,679 12/1995 Paoluccio ..... 2/9
5,592,687 1/1997 Lajeunesse ..... 2/9

* cited by examiner

*Primary Examiner*—Stephen Gravini
(74) *Attorney, Agent, or Firm*—Joseph N. Breaux

(57) ABSTRACT

A hair drying method that includes the steps of providing and installing a face shield including shielding elements for shielding the eye and ear canal areas prior to blowing hot air onto the hair to be dried.

1 Claim, 1 Drawing Sheet

HAIR DRYING METHOD INCLUDING AN EYEGLASS ASSEMBLY

TECHNICAL FIELD

The present invention relates to hair care methods and more particularly to a hair drying method that includes the steps of a) providing a face shield assembly including an eyeglass assembly, a front gasket member and two ear canal protection members; the eyeglass assembly including a front frame portion having a frame nose receiving notch positioned between two viewing lenses and two earpieces pivotally connected to opposed side ends of the front frame portion; the front gasket member being secured to the front frame portion and having two eye openings, one in alignment with each of the viewing lenses, a gasket nose notch in alignment with the frame nose receiving notch, and two end flaps that extend from opposite gasket ends of the front gasket member back toward ear encircling tip ends of the side members; the two ear canal protection members each including an ear canal insertion portion in connection with an ear cover pad; each ear canal protection member being tethered to one of the side members with a flexible tether; b) positioning the face shield assembly onto the face of the wearer such that the eyes of the wearer are positioned behind the two viewing lenses, the nose of the wearer is positioned into the frame nose receiving notch, the front gasket provides a seal between the front frame portion and the face area of the wearer, and the each of the ear canal insertion portions of the two ear canal protection members is inserted into an ear canal of the wearer in a manner such that the respective ear cover pad covers an area of the ear of the wearer; and c) blowing hot air onto the hair until the hair is dry.

BACKGROUND ART

The hot air used dry hair can be uncomfortable when blown into the eyes and ear canals. It would be desirable, therefore, to have a hair drying method that included providing and installing a face shield including shielding elements for shielding the eye and ear canal areas prior to blowing the hot air onto the hair until it is dried.

GENERAL SUMMARY DISCUSSION OF INVENTION

It is thus an object of the invention to provide a hair drying method that includes the steps of a) providing a face shield assembly including an eyeglass assembly, a front gasket member and two ear canal protection members; the eyeglass assembly including a front frame portion having a frame nose receiving notch positioned between two viewing lenses and two earpieces pivotally connected to opposed side ends of the front frame portion; the front gasket member being secured to the front frame portion and having two eye openings, one in alignment with each of the viewing lenses, a gasket nose notch in alignment with the frame nose receiving notch, and two end flaps that extend from opposite gasket ends of the front gasket member back toward ear encircling tip ends of the side members; the two ear canal protection members each including an ear canal insertion portion in connection with an ear cover pad; each ear canal protection member being tethered to one of the side members with a flexible tether; b) positioning the face shield assembly onto the face of the wearer such that the eyes of the wearer are positioned behind the two viewing lenses, the nose of the wearer is positioned into the frame nose receiving notch, the front gasket provides a seal between the front frame portion and the face area of the wearer, and the each of the ear canal insertion portions of the two ear canal protection members is inserted into an ear canal of the wearer in a manner such that the respective ear cover pad covers an area of the ear of the wearer; and c) blowing hot air onto the hair until the hair is dry.

Accordingly, a hair drying method is provided. The hair drying method includes the steps of a) providing a face shield assembly including an eyeglass assembly, a front gasket member and two ear canal protection members; the eyeglass assembly including a front frame portion having a frame nose receiving notch positioned between two viewing lenses and two earpieces pivotally connected to opposed side ends of the front frame portion; the front gasket member being secured to the front frame portion and having two eye openings, one in alignment with each of the viewing lenses, a gasket nose notch in alignment with the frame nose receiving notch, and two end flaps that extend from opposite gasket ends of the front gasket member back toward ear encircling tip ends of the side members; the two ear canal protection members each including an ear canal insertion portion in connection with an ear cover pad; each ear canal protection member being tethered to one of the side members with a flexible tether; b) positioning the face shield assembly onto the face of the wearer such that the eyes of the wearer are positioned behind the two viewing lenses, the nose of the wearer is positioned into the frame nose receiving notch, the front gasket provides a seal between the front frame portion and the face area of the wearer, and the each of the ear canal insertion portions of the two ear canal protection members is inserted into an ear canal of the wearer in a manner such that the respective ear cover pad covers an area of the ear of the wearer; and c) blowing hot air onto the hair until the hair is dry.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
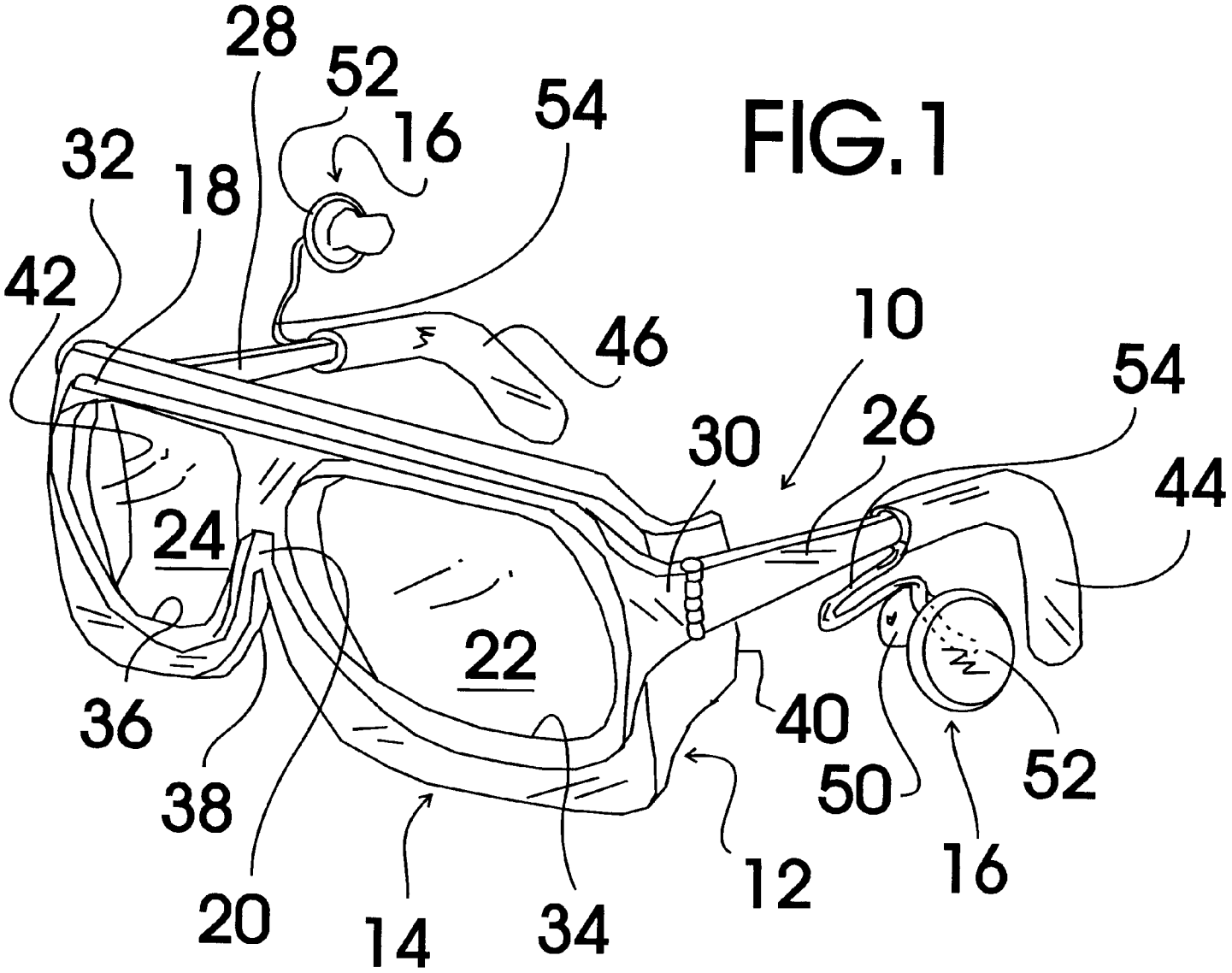
FIG. 1 is a perspective view of the face shield assembly provided in the hair drying method of the present invention showing the eyeglass assembly including a front frame portion having a frame nose receiving notch positioned between two viewing lenses and two earpieces pivotally connected to opposed side ends of the front frame portion; a front gasket member secured to the front frame portion and having two eye openings, one in alignment with each of the viewing lenses, a gasket nose notch in alignment with the frame nose receiving notch, and two end flaps that extend from opposite gasket ends of the front gasket member back toward ear encircling tip ends of the side members; and two ear canal protection members each including an ear canal insertion portion in connection with an ear cover pad; each ear canal protection member being tethered to one of the side members with a flexible tether.

FIG. 1 shows an exemplary embodiment of the face shield assembly, generally designated 10, provided in the hair drying method of the present invention. Face shield assembly 10 includes an eyeglass assembly, generally designated 12; a front gasket member, generally designated 14; and two ear canal protection members, each generally designated 16.

Eyeglass assembly 12 includes a front frame portion 18 having a frame nose receiving notch 20 positioned between two viewing lenses 22,24; and two earpieces 26,28 pivotally connected to opposed side ends 30,32 of front frame portion 18. Front gasket member 14 is secured to the wearer facing side of front frame portion 18 and has two eye openings 34,36, one in alignment with each of the viewing lenses 22,24, a gasket nose notch 38 in alignment with frame nose receiving notch 20, and two end flaps 40,42 that extend from opposite gasket ends of front gasket member 14 back toward ear encircling tip ends 44,46 of side members 26,28. The two ear canal protection members 16 each include an ear canal insertion portion 50 in connection with an ear cover pad 52. Each ear canal protection member 16 is tethered to one of the side members 26,28 with a flexible tether 54.

An exemplary embodiment of the hair drying method of the present invention includes the steps of: a) proving a face shield assembly 10; b) positioning face shield assembly 10 onto the face of the wearer such that the eyes of the wearer are positioned behind the two viewing lenses 22,24, the nose of the wearer is positioned into the frame nose receiving notch 20, the front gasket 14 provides a seal between the front frame portion 18 and the face area of the wearer, and the each of the ear canal insertion portions 50 of the two ear canal protection members 16 is inserted into an ear canal of the wearer in a manner such that the respective ear cover pad 52 covers an area of the ear of the wearer; and c) blowing hot air onto the hair until the hair is dry.

It can be seen from the preceding description that a hair drying method has been provided.

It is noted that the embodiment of the hair drying method described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A hair drying method for drying hair, said hair drying method comprising the steps of:

a) providing a face shield assembly including an eyeglass assembly, a front gasket member and two ear canal protection members; said eyeglass assembly including a front frame portion having a frame nose receiving notch positioned between two viewing lenses and two earpieces pivotally connected to opposed side ends of said front frame portion; said front gasket member being secured to said front frame portion and having two eye openings, one in alignment with each of said viewing lenses, a gasket nose notch in alignment with said frame nose receiving notch, and two end flaps that extend from opposite gasket ends of said front gasket member back toward ear encircling tip ends of said side members; said two ear canal protection members each including an ear canal insertion portion in connection with an ear cover pad; each ear canal protection member being tethered to one of said side members with a flexible tether;

b) positioning said face shield assembly onto said face of said wearer such that said eyes of said wearer are positioned behind said two viewing lenses, said nose of said wearer is positioned into said frame nose receiving notch, said front gasket provides a seal between said front frame portion and said face area of said wearer, and said each of said ear canal insertion portions of said two ear canal protection members is inserted into an ear canal of said wearer in a manner such that said respective ear cover pad covers an area of said ear of said wearer; and c) blowing hot air onto said hair until said hair is dry.

* * * * *